United States Patent [19]

Tatum, Jr.

[11] Patent Number: 4,786,388

[45] Date of Patent: Nov. 22, 1988

[54] GROUND ELECTRODE BACKFILL COMPOSITION, ANODE BED AND APPARATUS

[75] Inventor: Joseph F. Tatum, Jr., Hattiesburg, Miss.

[73] Assignee: Cathodic Engineering Equipment Company, Hattiesburg, Miss.

[21] Appl. No.: 95,593

[22] Filed: Sep. 14, 1987

[51] Int. Cl.[4] ..... C23F 13/00

[52] U.S. Cl. ..... 204/197; 174/6

[58] Field of Search ..... 204/147, 196–197, 204/148; 174/6

[56] References Cited

U.S. PATENT DOCUMENTS

| | | | |
|---|---|---|---|
| 2,495,466 | 1/1950 | Miller | 204/197 |
| 2,552,208 | 5/1951 | Mudd | 174/6 |
| 2,553,654 | 5/1951 | Heise | 174/6 |
| 3,725,609 | 4/1973 | Tatum | 174/6 |
| 3,941,918 | 3/1976 | Nigol et al. | 174/140 C |
| 3,962,142 | 6/1976 | Freeman et al. | 252/503 |
| 4,018,715 | 4/1977 | Tatum | 252/510 |
| 4,069,870 | 1/1978 | Gallus | 166/293 |
| 4,170,532 | 10/1974 | Tatum | 204/147 |
| 4,255,241 | 3/1981 | Kroon et al. | 204/147 |
| 4,525,263 | 6/1985 | Parkhurst et al. | 204/225 |
| 4,526,667 | 7/1985 | Parkhurst et al. | 204/147 |

FOREIGN PATENT DOCUMENTS

| | | |
|---|---|---|
| 0044233 | 11/1978 | Japan . |
| 0126282 | 10/1981 | Japan . |
| 1445611 | 8/1976 | United Kingdom . |
| 1476081 | 6/1977 | United Kingdom . |

*Primary Examiner*—R. L. Andrews

*Attorney, Agent, or Firm*—Dowell & Dowell

[57] ABSTRACT

A low resistance non-permeable backfill especially for use in vertical anode beds for cathodic protection of subsurface metallic structures includes a mixture of carbonaceous materials, naturally occurring graphite lubricants, additives to reduce the apparent viscosity of the slurry and portland cement mixed with water and pumped as a high density fluidized suspension into the anode bed, particularly around the casing of a deep anode bed of the general type described in United States patent to Tatum U.S. Pat. No. 3,725,669.

8 Claims, 1 Drawing Sheet

RECTIFIER
TO POWER
+
−
41
40
42
53
55
25
52
51
21
20
39
54
43
50
45
38
37
48
36
26
35
32
27
29
34
30
33
31
63
60
65
66
62

GROUND ELECTRODE BACKFILL COMPOSITION, ANODE BED AND APPARATUS

BACKGROUND OF THE INVENTION

This invention relates generally to backfill materials for ground bed anodes, particularly of the vertically positioned type, and to improvements in vertically positioned anode beds, particularly deep beds of the general type described in U.S. Pat. No. 3,725,669 to Joe F. Tatum.

The practice of utilizing deep well anode beds to prevent corrosion and rapid deterioration of subsurface metallic structures is an effective method of increasing the life of such structures.

Under various conditions, corrosion of subsurface metallic structures is electrolytically induced by the creation of anodic and cathodic areas on the metallic structures. It was found that corrosion occurred at the anodic area of the structure at which a current flow was established into the surrounding soil and water which acted as an electrolytic medium. However, the cathodic areas of the subsurface structures at which the flow of current was directed or collected from the surrounding medium were found to remain relatively free from corrosive action.

In order to prevent the corrosive action at anodic areas along the subsurface structures, it was determined that various forms of electrodes could be placed in the ground adjacent to the structure and a current supplied thereto and into the surrounding soil to the structure. In this manner, the electrode acted as an anode which became subject to electochemical attack and the subsurface metallic structure was protected from such corrosive action as its surface was established as a cathodic area by connecting conductors between such structure and the current source. Such a system has become known in the field as cathodic protection.

Cathodic protection has been widely accepted. However, its effectiveness depends on the effective life of the electrode used to establish current flow. Early electrodes consisted of utilizing metallic pipes, rails, beams and various metal scraps which were buried in the ground adjacent the subsurface structure to be protected. Since such electrodes were subject to corrosive effects, their maximum effective life was dependent upon the weight of the material, the amount of current used, and the soil conditions including soil acidity and moisture content.

In use such electrodes tended to separate along areas of localized corrosion and therefore portions of the electrode were removed or separated from the current supply. Such localized corrosion substantially decreased the effective life of the electrode resulting in an effective life range generally between four to eight years, depending upon the various conditions mentioned above.

In order to provide continuous cathodic protection it is necessary to replace the expended electrodes, adding significantly to the expense of maintaining such a system. In addition to the metallic anodes previous described, various carbon and graphite electrodes have come into widespread use.

From the above, it is apparent that in order to increase the economical operation of a cathodic protection system, it is desirable to utilize electrodes having a low rate of consumption in terms of pounds of electrode per ampere per year. Further, the cost of electrode replacement is an important consideration.

As discussed above, the rate of consumption of the anode material was subject to various factors including possible localized separation. In this respect, it was noted that the rate of consumption was dependent upon the current density at the interface of the anode and the soil medium. In order to provide or establish a more uniform flow of current along the length of the anode, use was made of a uniformly resistive backfill material to completely surround the anode. Material including granular, fine grain or pulverized carbon substances including calcined coke, graphite and the like became frequently used not only to provide a uniformly resistive medium but also to effectively decrease the electrical resistance of the circuit material between the anode and the protected material cathode. As discussed in U.S. Pat. No. 2,553,654 to Heise, the use of such backfill permitted a significantly increased current density along the anode.

The backfill has customarily been poured around the anode or anodes and permeated with water in order to promote electrical conductivity between the anode system and the earthen wall of the well. A deep well system employing backfill is described in the above mentioned patent to Tatum U.S. Pat. No. 3,725,669.

Inasmuch as any well may intersect with water bearing strata at different levels it is apparent that a well for anodes for the purpose of providing cathodic protection, and having water permeable backfill between the strata, may permit the transfer of liquid to and between the strata. With greater attention now being directed to the preservation of water quality it becomes desirable or necessary to construct anode beds in wells in such a manner as to prevent the transfer of liquid from the well hole to any water bearing stratum. Such liquid may originate at the surface and flow downwardly into the well or it may pass from any stratum into the well and then into another stratum. The passage of liquid from outside a given stratum into it may be inconsistent with efforts to prevent contamination of the environment.

DESCRIPTION OF THE PRIOR ART

The Tatum U.S. Pat. No. 3,725,669 describes the type of system or environment for which the backfiil of the present invention is particularly adapted.

The Tatum U.S. Pat. Nos. 4,170,532 and 4,175,021 disclose vertical anode systems having casings of dielectric material with windows for electrical communication.

The Tatum U.S. Pat. No. 4,018,715 describes a backfill material for use in anode beds, comprising a mixture of particulate calcined fluid petroleum coke, powdered graphite and a surfactant.

LORESCO brochures A and B, produced by Cathodic Engineering Equipment Company, Inc. describe various low resistance backfill materials and their manner of use.

The Heise U.S. Pat. No. 2,553,654 describes a ground electrode and conductive backfill.

The Miller U.S. Pat. No. 2,495,466 discloses a packaged anode including a magnesium anode encased within a block of cement and gypsum and placed in a dug hole.

The United States patent to Nigol et al. discloses a cement for mechanically and electrically joining metal hardware to an insulator shell.

The Freeman et al. U.S. Pat. No. 3,962,142 discloses a concrete for use in flooring which contains electrically conductive particulate material.

The British Pat. No. 1,445,611 of 1976 discloses concrete formed using an aggregate of calcined oil coke, graded as for a normal aggregate, to provide conductive concrete material for use as structural material.

The British Pat. No. 1,476,081 of 1977 discloses an improvement on British Pat. No. 1,445,611 wherein the composition prepared ready for setting is subjected to pressure.

The digest of Japanese Pat. No. JE0044233 of 1978 discloses a homogenous mixture of carbon powder and quicklime in which cement powder is used for the curing agent for use in lowering "earthing" electric resistance.

The digest of Japanese Pat. No. JA0126282 of 1981 discloses a ground resistance decreasing composition containing calcium sulfate, a burned mixture of silica and quick lime, and conductive material.

SUMMARY OF THE INVENTION

The present invention is embodied in an electrically conductive backfill having a cement component especially adapted to be pumped into a portion of a vertical anode groundbed of the type described in the Tatum U.S. Pat. No. 3,725,669 according to the general method described in that patent in order to produce groundbed apparatus having a non-permeable concrete annulus in contact with the earthen bore of the groundbed.

The invention enables one to avoid water quality degradation while at the same time achieving a low resistance ground contact through non-permeable material. It is proposed that the material will be used on the outside of a casing and conventional anodes and carbonaceous backfill will be used on the inside of the casing.

It is the purpose of the non-permeable but conductive backfill or grout on the outside of the casing to prevent contamination or degradation of water quality through the transfer of material from one water bearing structure to another or from the ground surface to a water bearing structure.

DESCRIPTION OF THE PREFERRED EMBODIMENTS

Figures 1, 2:
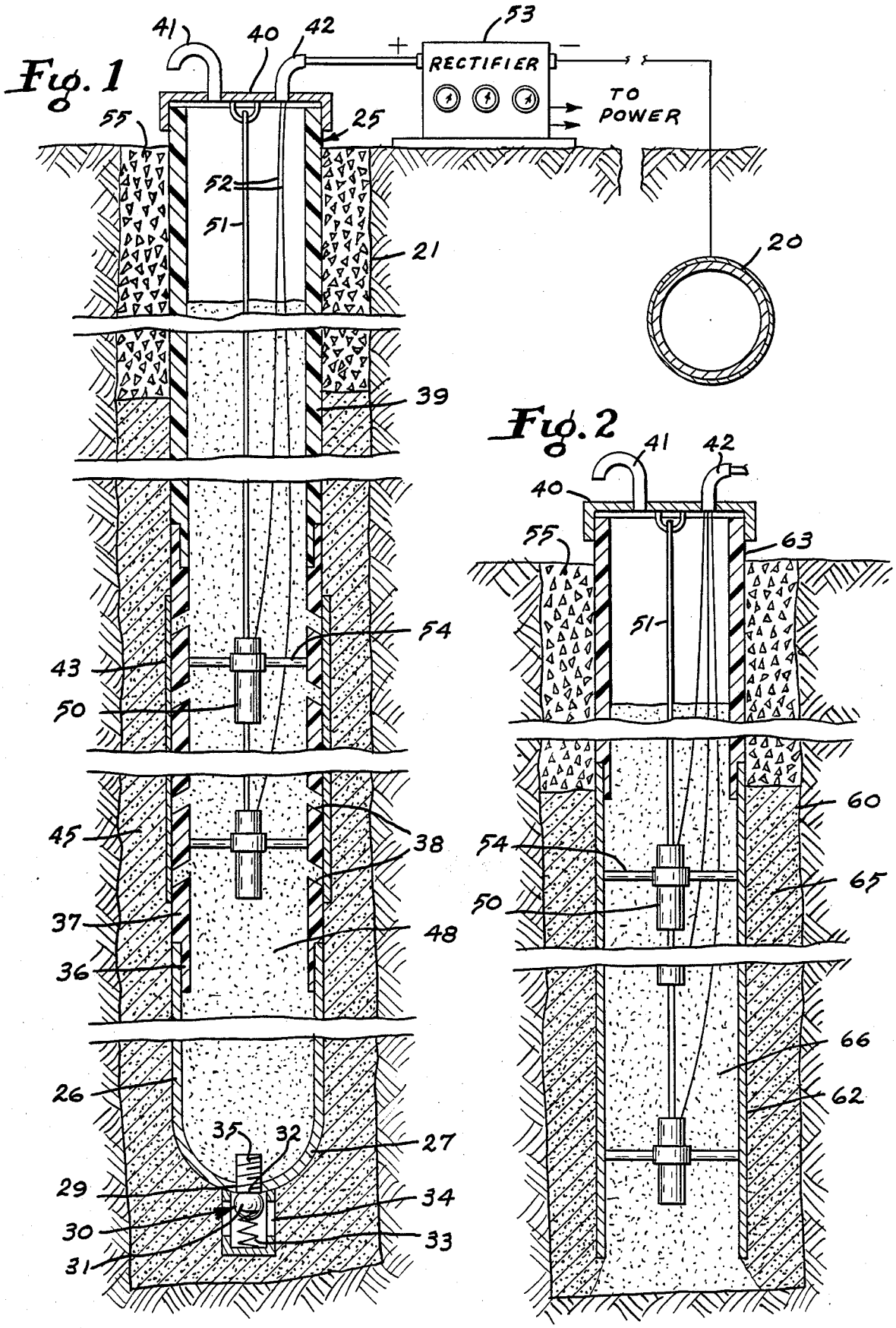
FIG. 1 is a vertical section of a deep anode bed for cathodic protection, illustrating its electrical connection to the remainder of a conventional system, and illustrating the backfill of the present invention in an environment as described in the Tatum U.S. Pat. No. 3,725,669.
FIG. 2 is a vertical section of a deep anode bed illustrating the use of the backfill of the present invention in an alternative environment.

Calcined fluid petroleum coke is especially advantageous for use as a backfill material due to its characteristic hard round-grain uncrushable shape. Such shape is particularly advantageous in the manufacture of non-porous yet easily applied conductive grout. By the addition of naturally occurring graphite flakes, grouting mixtures became even more conductive. Further, the use of additives to reduce the apparent viscosities, increases the flowability and the contractibility of the conductive grout to facilitate its application in a deep anode system. As an example, a dry backfill material was prepared by blending a mixture of 83.5% by weight calcined fluid petroleum coke, 15% by weight portland (API Class A) cement, 1% by weight naturally occurring graphite flakes and 0.5% by weight Hercules SP 950, (formulated nonionic surfactant produced by Hercules, Incorporated, Wilmington, Del., 19899). The calcined coke was of a size to pass a Tyler Standard number 16 sieve. The dry grouting backfill was pumped on the outside of a deep well casing by mixing with water using a liquid to solid density of approximately 6–7 gallons of water for each 100 pounds of material. It was observed that a homogeneous mixture was produced and a homogeneous grout resulted on the outside of the casing after allowing 24 hours for the cement to set.

Various mixtures similar to that of the prior example can be effectively prepared utilizing the various components in the following ranges:

| | Percent by Weight of Total Mixture |
|---|---|
| Calcined Fluid Petroleum Coke Tyler Standard - 16 mesh and smaller | 83.5–85 |
| Portland (API Class A) Cement | 15–16 |
| Powdered Graphite | .75–1.25 |
| Surfactant (Hercules SP-950) | .25–.5 |

Other surfactants may be used than Hercules SP-950. It is the purpose of the surfactants to reduce the apparent viscosity of the cement carbonaceous backfill mix and to make it pumpable with standard field equipment in order to apply it.

In the preparation of the backfill material, the calcined fluid petroleum coke in a dry state is first sieved to size in order to pass a Tyler Standard number 16 sieve. After the calcined fluid petroleum coke has been sized, it is blended with naturally occurring graphite flakes, dry surfactant and portland (API Class A) cement. The resultant dry blend or mixture is subsequently bagged and ready for delivery to a user.

Because of the non-porous nature of the resulting concrete, it is not intended for use directly on an anode's surface. Therefore, it is intended that cathodic protection systems will utilize a standard carbonaceous material within the confines of the casing and would use the backfill of this invention on the outside of the casing in order to comply with environmental laws for the sealing of strata.

A preferred environment for the invention is described in the Tatum U.S. Pat. No. 3,725,669. The present invention is an adaptation to and of the invention described in that patent. Accordingly, the present inventor makes no claim of inventorship in the subject matter of that patent. Its disclosure herein is used as an illustration of subject matter or environment with which the present invention may be employed.

With continued reference to the drawings, a steel pipeline or other metallic underground structure 20 is provided which must be protected from corrosion to increase the life of such structure, as well as to reduce maintenance thereon. In order to prevent or reduce corrosion on the pipeline 20, a deep well ground bed is formed by drilling a bore hole 21 to any required depth, such as 200 to 250 feet in a typical situation.

After the bore hole has been drilled, a casing 25 of a diameter less than the diameter of the bore hole is lowered into such bore hole. The casing 25 is of a length to rest on the bottom of the bore hole, extend the full length thereof, and terminate slightly above the surface of the ground. The casing 25 includes a tubular base portion 26 constructed of iron, steel, or other metal having a bottom wall 27 and with the upper end being open. The bottom wall 27 of the base portion is provided with an opening 29 in which a check valve 30 is received. Such check valve includes a ball 31 normally urged into engagement with a seat 32 by means of a spring 33. A plurality of slots 34 around the lower portion of the check valve permits material to be discharged through the check valve into the area surrounding the casing 25. The upper portion of the check valve 30 extends into the base portion 26 and is provided with threads 35 for a purpose which will be described later.

The open upper end of the metallic base portion 26 receives and is connected to a reduced end 36 of a lower pipe section 37 of the casing. The lower pipe section is provided with a plurality of openings 38 with each of the openings being angularly disposed from a lower outer position to an upper inner position and extending entirely through the wall thickness of the lower pipe section. A plurality of imperforate upper pipe sections 39 are connected to the lower pipe section and extend upwardly to a position above the surface of the ground. The lower pipe section 37 and each of the upper pipe sections 39 are constructed of an inert thermoplastic material which is chemically stable in the present of oxygen, hydrogen, chlorine, strong acids and strong bases, and is not subject to deterioration from concentrated electric fields.

A cap 40 is fixed to the upper end of the casing 25 and such cap includes a vent 41 and an electrical conduit inlet 42. A sleeve 43, which preferably is constructed of sheet steel or other conductive material, is disposed about the lower pipe section 37 in a position to initially cover the openings 38 to substantially prevent the ingress of foreign material into the casing.

As the casing is lowered into the bore hole, such casing will displace a substantial quantity of the mud and cause the mud to be discharged from the the top of the bore hole. After the casing 25 is in place at the bottom of the bore hole 21, a wash pipe, not shown, is threadedly connected to the threads 35 of the check valve 30 so that such wash pipe extends entirely through the casing 25.

With the casing 25 in position, one end of a hose, not shown, is connected to the upper end of the wash pipe and the opposite end is connected to a source of clean water under pressure so that such water is introduced into the wash pipe. Water under pressure opens the check valve 30 and is discharged through the slots 34 into the bottom of the bore hole until the fluid being discharged at the top is substantially clear and most of the mud has been removed.

When the water being discharged from the bore hole 21 is substantially clear, the hose is disconnected from the water supply and is connected to a hopper (not shown) containing water in which the backfill mixture 45 of the present invention is suspended or fluidized. The slurry of water and such backfill mixture is introduced under pressure into the wash line and is discharged through the check valve 30 into the space between the bore hole 21 and the casing 25. The injection of such material continues until the upper level of such material is located at an appropriate level above the uppermost openings 38, which may be approximately 100 to 120 feet above the bottom of the bore hole in a typical situation. The hose is then disconnected from the carbonaceous material supply hopper and is connected to a source of water under pressure so that the back fill material within the wash line will be discharged exteriorly of the casing 25. Meantime, the cementious backfill mixture of the present invention begins to setup or harden.

When the surplus backfill material has all been discharged from the wash line, such wash line is disconnected from the check valve 30 and is separated therefrom by a few feet. The check valve 30 will prevent the cementitious backfill material and any surplus water located exteriorly of the casing from entering the bottom of the casing.

Clear water under pressure then is introduced into the wash line to remove any mud or foreign matter which has seeped into the casing, after which the wash line is removed. A plurality of anodes 50 of high silicon cast iron, graphite, carbon or steel material are mounted on a support line 51 of an inert material such as nylon or the like having poor electric current carrying qualities. The anodes 50 are connected by well insulated electrical conduits 52 to the positive side of a rectifier 53. The negative side of the rectifier is connected to the pipe line 20. The rectifier 53 is connected to a suitable source of AC power and is adapted to rectify the AC power to provide a direct current to the anodes 50. Although a rectifier has been illustrated and described, it is noted that any conventional source of DC power, such as a storage battery or the like, could be used. Also, it is noted that the support line 51 could be omitted in which case the anodes would be supported by the electrical conduits 52.

Each of the anodes 50 preferably is provided with one or more centering devices 54 constructed of any desired material such as mild steel or the like, to maintain the anodes 50 substantially along the vertical axis of the casing 25. Such anodes are lowered into the casing 25 until the lowermost anode reaches a predetermined position above the base portion 26 of the casing. When the anodes are in position, any desired fluidized carbonaceous material 48, not that of the present invention, is introduced into the casing to fill the interior thereof to a desired level, at least above the uppermost openings 38.

Gravel 55 is preferably introduced into the upper annulus between the bore hole 21 and the casing 25 and above the backfill material 45 located therein. Gravel is not a good conductor of electric current, and therefore, the current discharged by the anodes 50 will not be dissipated to the surface. After the interior of the casing 25 has been filled to the desired level, the support line 51 is connected to the cap 40 and the carbonaceous material 48 is permitted to settle for approximately 24 hours, after which the anodes are energized by the rectifier 53.

Although one procedure has been described for installation of the backfill of the present invention, the invention contemplates that alternative procedures may be employed. Thus, instead of pumping it upwardly from the bottom it may be pumped from a different level in the bore hole. Also, while a procedure according to the Tatum U.S. Pat. No. 3,725,669 has been described for installation of the vertical anode ground bed, it is contemplated that other procedures and variations in apparatus may be used within the limits of operativeness.

Thus, as an illustration of the use of the backfill of the present invention in an alternative environment reference is made to FIG. 2. In FIG. 2, the bore hole 60 receives a casing having a lower portion 62 which may be of a conductive metal such as steel and an upper portion 63 which is of an inert non-conductive thermoplastic material. The anodes 50 are positioned at predetermined levels within the conductive casing portion 62.

The backfill 65 made in accordance with the present invention and which surrounds the casing extends from the bottom of the bore hole upwardly above the region of the uppermost anode 50. Above it non-conductive gravel 55 is placed. Within the casing the conventional backfill, 66, not in accordance with the present invention, extends upwardly also above the region of the uppermost anodes 50.

After a period of operation of the system, the metal pipe portion 62, at least in the regions opposite the anodes 50, will probably corrode away. However, the concrete shell formed by the outer backfill 65 will maintain the stability of the hole and continue to conduct current. The concrete shell will also maintain the stability of the hole to facilitate replacement of the anodes, if required, as described in the Tatum, U.S. Pat. No. 3,725,669.

I claim:

1. A conductive non-porous backfill material for earth anode beds comprising, a mixture of sized calcined fluid petroleum coke, naturally occurrihg graphite flakes, viscosity reducers and portland cement.

2. A conductive non-porous backfill material for earth anode beds comprising a mixture of the following components:

| | Percent by Weight of Total Mixture |
|---|---|
| Calcined Fluid Petroleum Coke | 83.5–85 |
| Portland Cement | 15–16 |
| Powdered Graphite | .75–1.25 |
| Surfactant | .25–.5 |

3. The backfill material of claim 1 in which said particular calcined fluid petroleum coke is of a size to pass a Tyler Standard number 16 sieve.

4. The conductive non-porous backfill material of claim 1 in which said surfactant is nonionic.

5. In apparatus for cathodically protecting underground metallic structure having an elongated hollow tubular rigid casing for reception within a deep bore hole, said casing having at least an upper portion constructed of substantially rigid chemically inert nonconductive material with a plurality of openings adjacent to the lower end only, at least one anode, means for suspending said anode within said casing in the area of said openings, first granular electrically conductive material within said casing and intimately engaging said anode, and second granular electrically conductive material filling the lower portion of the bore hole exteriorly of said casing at least to a level above said openings, and means for supplying direct electrical energy to said anode, whereby electrical energy flows from said anode through said first and second conductive materials and through the earth to the underground metallic structure to cause the underground structures to become cathodic and thereby substantially prevent corrosion of such structure, the improvement comprising, said second electrically conductive material comprising concrete formed from a hydrated mixture according to any of claims 1, 2, 3 or 4.

6. Apparatus for cathodically protecting underground metallic structures comprising an elongated hollow tubular rigid casing for reception within a deep bore hole, said casing having an upper portion constructed of substantially rigid chemically inert nonconductive material and a lower portion of conductive material, at least one anode, means for suspending said anode within said lower portion of said casing, first granular electrically conductive material within said casing and intimately engaging said anode, and second granular conductive hydrated material according to any of claims 2, 3, 4 or 5 forming a concrete annulus around said lower portion of said casing and filling the lower portion of the bore hole exteriorly of said casing at least to a level above said anode, and means for supplying direct electrical energy to said anode, whereby electrical energy flows from said anode through said first and second conductive material and the lower portion of said casing through the earth to the underground metallic structure to cause the underground structure to become cathodic and thereby substantially prevent corrosion of such structure.

7. In the method of making a deep anode bed for the cathodic protection of underground metallic structures comprising the steps of: drilling a deep bore hole in the earth, inserting an elongated hollow casing having a generally tubular wall of relatively rigid chemically inert non-conductive material into said bore hole, the lower portion of said casing wall having a plurality of openings therethrough, filling the annulus between the bore hole and the exterior of said casing with electrically conductive material to a predetermined level above the bottom of the bore hole and at least above the level of said openings, attaching at least one anode to a support means, introducing said anode and at least a portion of said support means into said casing, filling the interior of said casing with granular electrically conductive material to at least above the level of said openings after said anode is in place so that the conductive material within said casing is in intimate engagement with said anode and communicates with the conductive material exteriorly of said casing through said openings, and electrically connecting said anode to a source of direct electrical energy, whereby electrical energy flows from said anode through said interior and exterior conductive material and through the earth to the metallic structure so that the underground metallic structure becomes cathodic, the improvement comprising filling the annulus between the bore hole and the exterior of said casing with a hydrated mixture according to any of claims 1, 2, 3 or 4 to form an electrically conductive concrete shell around the casing.

8. The method of making a deep anode bed for the cathodic protection of underground metallic structures comprising the steps of: drilling a deep bore hole in the earth, inserting an elongated hollow casing having a generally tubular wall into said bore hole, the upper portion of said casing constructed of substantially rigid inert non-conductive material, the lower portion of said casing formed of substantially rigid conductive material, filling the annulus between the bore hole and the exterior of said casing with a hydrated mixture according to any of claims 1, 2, 3 or 4 to a predetermined level above the bottom of the bore hole substantially commensurate with the lower portion of said casing to form an electrically conductive concrete shell and around the casing, attaching at least one anode to a support means, introducing said anode and at least a portion of said support means into said casing, filling the interior of said casing with granular electrically conductive material after said anode is in place to the extent that the conductive material within said casing is in intimate engagement with said anode and communicates electrically with the conductive shell exteriorly of said casing through said lower portion of said casing, and electrically connecting said anode to a source of direct electrical energy, whereby electrical energy flows from said anode through said interior material and exterior shell and said lower portion of said casing and through the earth to the metallic structure so that the underground metallic structure becomes cathodic.

* * * * *